United States Patent [19]

Wooding

[11] 4,131,752

[45] Dec. 26, 1978

[54] CURRENT CONDUCTING ATMOSPHERE CONTROL SLEEVE FOR ELECTROSLAG FURNACE

[75] Inventor: Patrick J. Wooding, Moorestown, N.J.

[73] Assignee: Wooding Corporation, Moorestown, N.J.

[21] Appl. No.: 794,043

[22] Filed: May 5, 1977

Related U.S. Application Data

[63] Continuation-in-part of Ser. No. 773,334, Mar. 1, 1977, and a continuation-in-part of Ser. No. 616,365, Sep. 24, 1975, Pat. No. 4,032,705.

[51] Int. Cl.[2] ..... H05B 3/60; F27B 14/12

[52] U.S. Cl. ..... 13/9 ES; 13/31 R

[58] Field of Search ..... 13/9, 12, 31, 32, 9 ES

[56] References Cited

U.S. PATENT DOCUMENTS

| | | | |
|---|---|---|---|
| 3,246,070 | 4/1966 | Wooding | 13/31 |
| 3,672,428 | 6/1972 | Tommaney | 13/12 X |

*Primary Examiner*—R. N. Envall, Jr.

*Attorney, Agent, or Firm*—Duffield & Lehrer

[57] ABSTRACT

An air tight sleeve is adapted to be moved between an inoperative position and an operative position wherein it extends between the top of a crucible of an electroslag melting furnace and the bottom of the furnace head. A seal is formed between the top of the crucible and the bottom of the sleeve and between the top of the sleeve and the bottom of the furnace head so that the atmosphere within the space between the furance head and the crucible can be controlled. Additionally, the sleeve is electrically connected to the bottom of the furnace head and to an electrically conductive water guide within the crucible wall so that the sleeve also functions as the return conductor.

11 Claims, 4 Drawing Figures

CURRENT CONDUCTING ATMOSPHERE CONTROL SLEEVE FOR ELECTROSLAG FURNACE

CROSS-REFERENCES TO RELATED APPLICATIONS

This application is a continuation-in-part of prior copending application Ser. No. 773,334 filed Mar. 1, 1977 and a continuation-in-part of prior copending application Ser. No. 616,365 filed Sept. 24, 1975 now U.S. Pat. No. 4,032,705.

BACKGROUND OF THE INVENTION

The present invention is directed toward an electroslag melting system and more particularly toward a system which utilizes an air tight sleeve to provide high integrity atmosphere control during electroslag melting and which also functions as a return conductor.

The electroslag melting process was first invented, developed and put into full production by R. F. Hopkins in the United States during the period between 1930 and 1960. This process employs a consumable electrode which is immersed in a pool of molten slag supported at the top of the resultant solidifying ingot enclosed within a cold-walled mold or crucible.

Alternating (or sometimes direct) current flows down the consumable electrode through the slag, down the ingot and back to the power supply. Preferably, the current flows back to the power supply in a coaxial manner to the top of the crucible such as shown in copending application Ser. No. 616,365, filed Sept. 24, 1975 now U.S. Pat. No. 4,032,705. This current, normally in the range of 1,000 amps per inch of ingot diameter, drops from fifteen to forty volts across the slag (or flux) pool thereby producing hundreds of kilowatts of melting power which consumes the tip of the electrode.

As a result of the foregoing, molten metal droplets form on the immersed electrode tip, detach themselves and fall through the molten flux pool to the ingot which is forming therebelow. As the metal droplets pass through the flux pool, they undergo chemical refinement. Progressive solidification of the ingot formed by this method leads to the physical isotropy and high yield associated with all consumable electrode processes.

Melting rates in the electroslag process are determined by the solidification characteristics of each alloy. However, as an average and for illustration purposes only, such rates are approximately 25 pounds per hour per inch of ingot diameter. Thus, a 24 inch diameter ingot of alloy steel might have an average melt rate of 600 pounds per hour. If this ingot has a typical height of 96 inches, its weight will be six tons and total melting time will, therefore, be approximately twenty hours.

As is known in the art, motion of the head of the electrode is the difference between the rate of burn-off of the electrode tip and the rate of build-up of the ingot being formed therebelow. In the preceding example, a twenty inch diameter electrode would typically be used and its consumable length would need to be greater than the ingot length in the inverse ratio of the squares of their diameter, assuming of course, full density for both.

During melting, gases which are deleterious to the finished ingot are capable of being transported across the molten slag and into the molten melter pool at the head of the ingot. This is particularly true of hydrogen gas. Thus, in alloys which are sensitive to the gas content and in particular to those which are subject to hydrogen embrittlement, it is most desirable to control the nature of the atmosphere above the molten slag.

This desirability becomes a virtual necessity as ingot diameters increase to approximately one meter and above for the following reasons. With this size ingot it is more difficult for hydrogen to migrate to the external surface of the ingot thereby removing the possiblity of hydrogen cracking. In addition, larger electroslag ingots are primarily required in the field of medium to heavy forgings and most forging grades are susceptible to hydrogen embrittlement.

In the past many different methods have been employed to achieve partial atmosphere control above the surface of the molten slag. Techniques such as hooding and flushing and the reliance upon the fact that argon is heavier than air to flood the space above the molten slag pool have been tried. However, none of these methods have been more than partially successful. This is true partially because of the very strong convection currents above the molten slag and partially because only a small amount of moist air brought in contact with the molten flux is sufficient to permit hydrogen to pass through the flux and into the solidifying ingot.

It is also true that most electroslag furnaces are of generally open geometry for a number of operating reasons. Therefore, the feasibility of high integrity atmosphere control in a production electroslag furnace has not been recognized until this time.

Electroslag melting has, in the past, been done in vacuum arc furnaces which means that full control of the atmosphere was automatically available to the melter. However, A.C. electroslag melting, which has become generally adopted because of improved refining characteristics cannot be conducted in a standard vacuum arc furnace because of eddy current heating and poor power factors.

In prior copending application Ser. No. 773,334 filed Mar. 1, 1977, a system was disclosed which provides high integrity atmosphere control of electroslag melting processes. As disclosed therein, this is accomplished by providing an air tight sleeve between the top of the crucible and the bottom of the furnace head. While this technique more than satisfactorily accomplishes the desired atmosphere control, it may create problems with the physical placement of the return conductors which normally are located within the space between the crucible and the furnace head. This problem becomes more apparent as the number and size of the return conductors increases with larger diameter furnaces.

SUMMARY OF THE INVENTION

In accordance with the present invention, an air tight sleeve is adapted to be moved between an inoperative position and an operative position wherein it extends between the top of a crucible of an electroslag melting furnace and the bottom of the furnace head. A seal is formed between the top of the crucible and the bottom of the sleeve and between the top of the sleeve and the bottom of the furnace head so that the atmosphere within the space between the furnace head and the crucible can be controlled. The sleeve is also electrically connected to the bottom of the furnace head and to an electrically conductive water guide within the crucible wall so that the sleeve also functions as the return conductor.

BRIEF DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

DETAILED DESCRIPTION OF THE INVENTION

Figure 1:
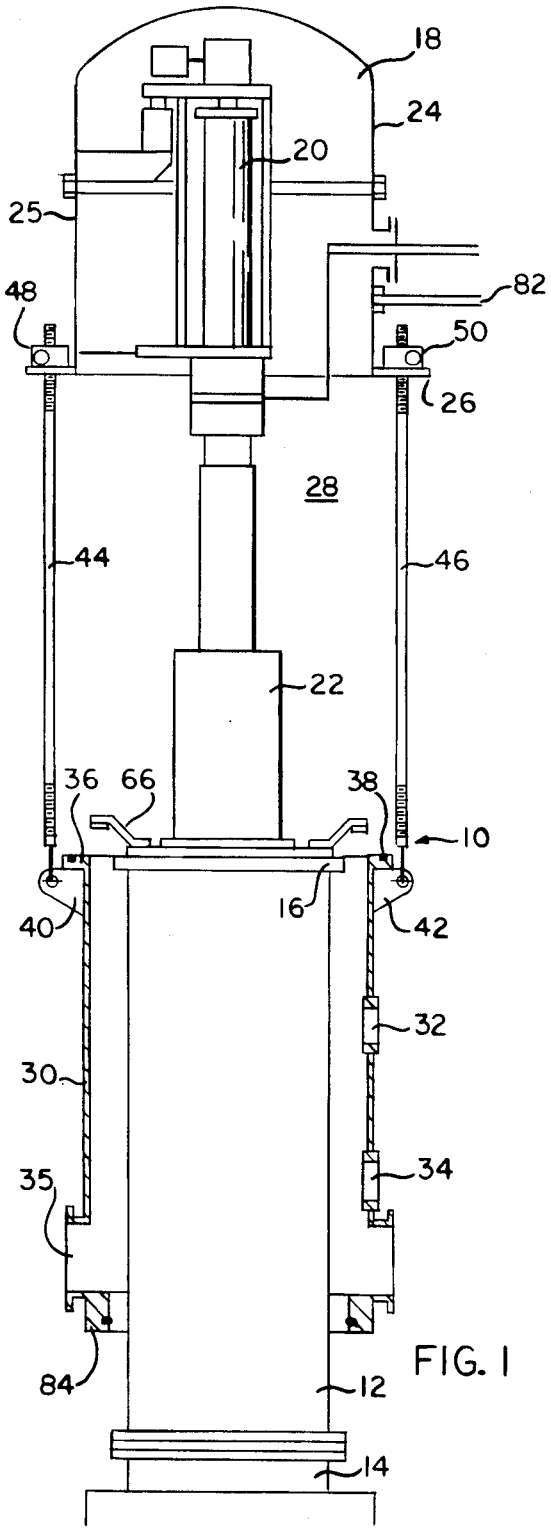
FIG. 1 is a front elevational view, partly in section, of an electroslag melting furnace constructed in accordance with the principles of the present invention and showing the sleeve in its inoperative position.
Figure 2:
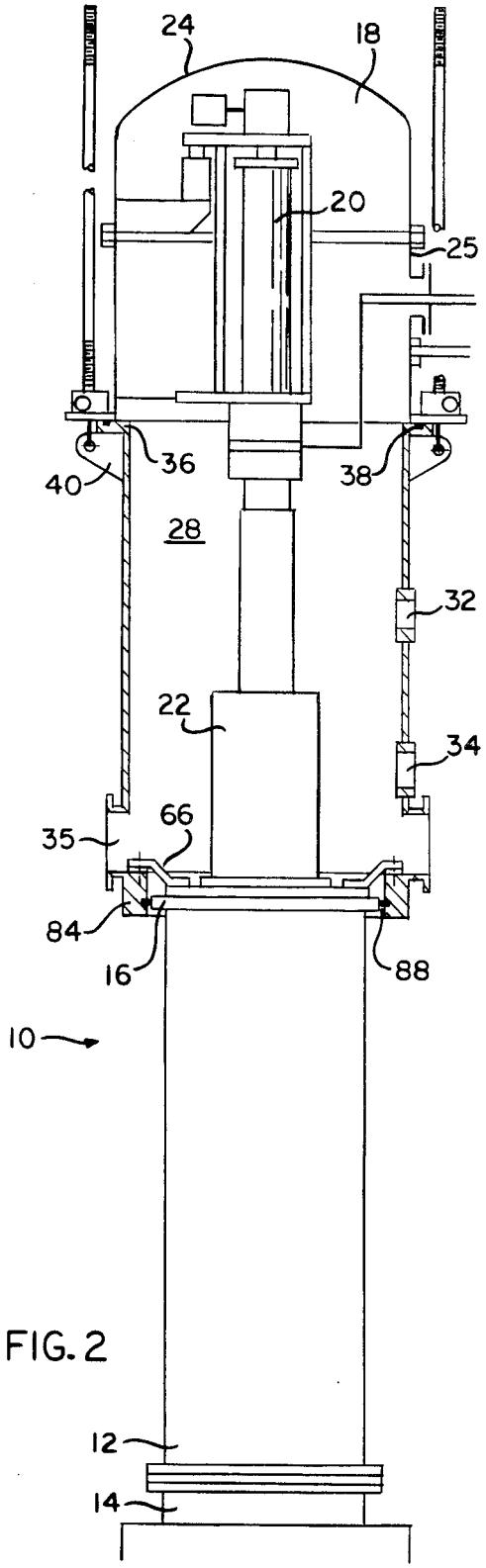
FIG. 2 is a view similar to FIG. 1 showing the sleeve in its operative position.

Referring now to the drawings in detail wherein similar reference numerals have been used in the several figures to designate similar elements, there is shown in FIGS. 1 and 2 an electroslag melting system constructed in accordance with the principles of the present invention and designated generally as 10.

Electroslag melting furnace 10 includes a crucible 12 which is mounted on a stool 14. As will be described more fully hereinafter, crucible 12 preferably includes a coaxial current return through an ultrahigh velocity water cooling guide. Crucible 12 also includes a horizontal and outwardly extending flange 16 adjacent the top thereof. In accordance with the invention, the entire crucible and stool are made to be air tight.

Located above the crucible 12 and spaced therefrom is a furnace head 18. Furnace head 18 includes a ram 20 which is used to lower consumable electrode 22 into crucible 12 for melting. Furnace head 18 also includes an air tight enclosure having an upper portion 24 and a lower portion 25 electrically insulated therefrom.

Thus, it can be seen that with the crucible 12 and the furnace head 18 being air tight, the entire system could be made air tight if the space 28 between the furnace head 18 and the crucible 12 could be made air tight. With this accomplished, the atmosphere within the crucible 12, the space 28 and the furnace head 18 could be controlled.

This is accomplished, in accordance with the present invention, by an atmosphere control sleeve 30 which is adapted to be placed around the space 28 between the crucible 12 and the furnace head 18. Sleeve 30 is preferably a machined aluminum fabrication and is substantially cylindrically shaped; the inside diameter of sleeve 30 being slightly larger than the overall outside diameter of the crucible 12. One or more ports such as 32 and 34 are formed in the wall of the sleeve 30. These may be used in conjunction with optical systems to view the melt and may be used to evacuate the air from within the crucible 12, furnace head 18 and space 28 and to replace the same with inert gas or desiccated air. Thus, ports 32 and 34 allow for the control of the atmosphere within the crucible 12. Additional ports 35 are also formed in the lower part of sleeve 30. As explained more fully below, the electrical connection between the crucible 12 and the sleeve 30 is accessible through the ports 35.

Sleeve 30 includes a horizontally outwardly extending flange 36 adjacent the top thereof. Flange 36 carries a static sealing O-ring 38 on its upper surface. A pair of ears 40 and 42 extend outwardly from the sleeve 30 at approximately 180° positions from each other. Connected to ears 40 and 42 are elongated screws 44 and 46, respectively. The upper ends of screws 44 and 46 engage hydraulic screw devices 48 and 50, respectively, which are mounted on the horizontal flange 26 of the enclosure 25. While only two screws and hydraulic screw devices are shown, it should be understood that any number of the same, equally spaced about the furnace, may be employed. Screws 44 and 46 are, of course, threaded throughout their entire length. Furthermore, it should be noted that the ears, screws and hydraulic devices are insulated so as not to provide an electrical connection between the enclosure 25 and the sleeve 30.

FIG. 1 shows the atmosphere control sleeve 30 in its inoperative position and surrounding the crucible 12, the bulk of which normally is below floor level. When the furnace 10 is to be operated, a fresh crucible is placed in position, an electrode inserted in the crucible, the electrode secured to the ram 20, and the atmosphere control sleeve 30 is then raised into position by the hydraulic devices 48 and 50. The sleeve 30 is raised until the static O-ring 38 is firmly compressed against the underside of the flange 26. At this point, the atmosphere control sleeve 30 may be locked into its upper or operative position by locking pins, jacks or other suitable means. With the sleeve locked into its upper position, an electrical connection is made between the sleeve 30 and the lower enclosure portion 25 with the use of a plurality of current carrying clamps.

Figure 3:
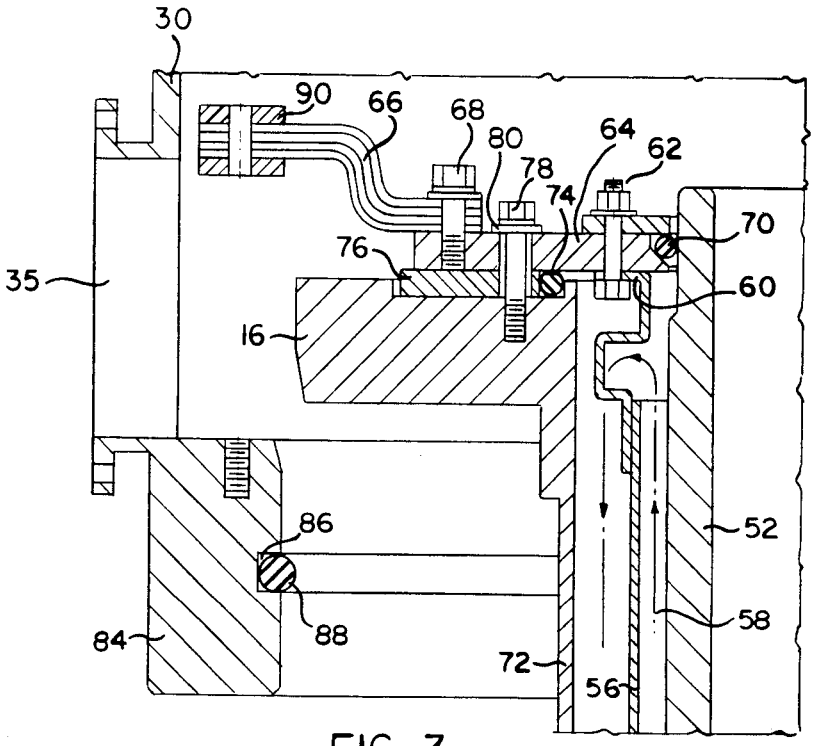
FIG. 3 is a detailed sectional view of the top of the crucible and bottom of the sleeve just prior to being interconnected.
Figure 4:
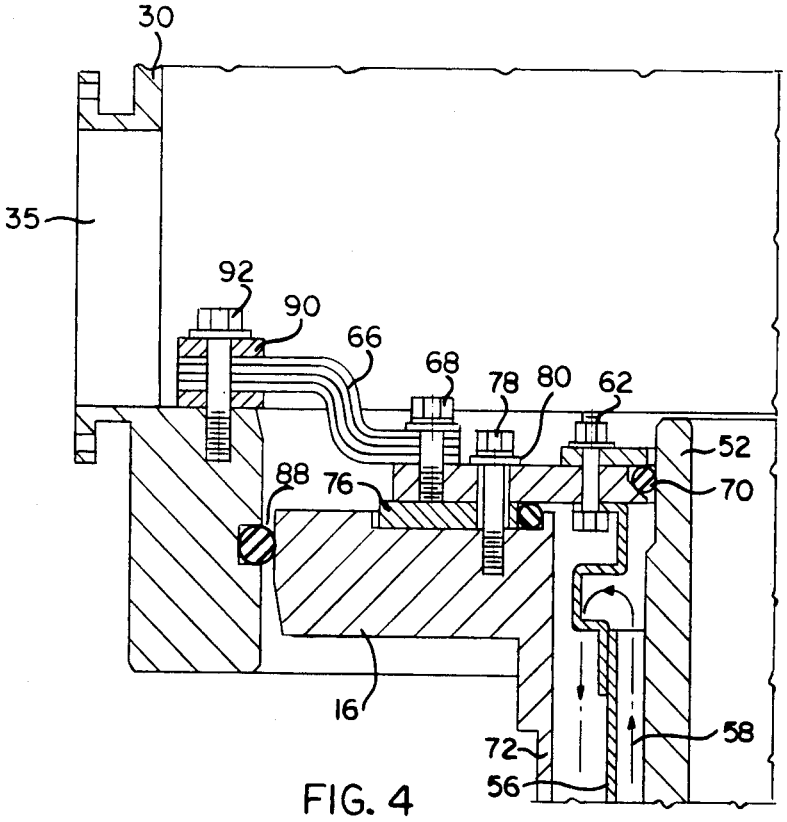
FIG. 4 is a view similar to FIG. 3 showing the final interconnection between the sleeve and crucible.

The manner in which the lower portion of sleeve 30 forms a seal with the upper portion of crucible 12 and the manner in which the electrical connection is made between the sleeve and the crucible is shown in FIGS. 3 and 4. The crucible 12 is formed of a crucible body 52 which is preferably of a cylindrical configuration and is preferably formed of a copper material. The crucible body 52 extends from the lower part of crucible 12 to a point slightly above the upper crucible flange 16.

An intermediate thin copper water guide 56 is positioned around and concentrically with the crucible body 52 and extends from the bottom of the crucible body to substantially the top thereof. The lower portion (not shown) of the intermediate water guide 56 is electrically interconnected to the lower portion (not shown) of the crucible body 52 by such means as clamping, brazing or any other appropriate method. The remainder of the inner walls of the water guide 56 are spaced from the outer walls of the crucible body 52 a distance of approximately one quarter of an inch throughout the entire height of both the crucible body and water guide and held in place by electrical insulators (not shown) parallel to the direction of water flow as shown by the arrows 58.

The extreme upper end of the water guide 56 includes an outturned circular flange 60. The flange 60 is appropriately electrically interconnected by bolt 62 to a circular conducting block 64 which, in turn, is electrically interconnected to a bus bar 66 by bolt 58. An O-ring 70 formed of an electrically insulating material is disposed within a groove in the connecting block 64. O-ring 70 rests against the outer surface of the upper portion of the crucible body 52 and maintains the crucible body electrically insulated from the bus bar 66.

The crucible assembly 12 also includes an outer cylindrical concentric steel crucible jacket 72. Crucible jacket 72 also extends from the bottom of the crucible body 52 to substantially the top thereof. The entire crucible jacket 72 including the lower edge (not shown) is electrically insulated from the crucible body 52 and the intermediate water guide 56. The upper portion of the crucible jacket 72 is integrally connected to the upper crucible flange 16 which may also be formed of a carbon steel material. An O-ring 74 and an electrically insulating ring 76 are fitted into a recess within the upper surface of the upper crucible flange 16. The O-ring 74 and insulating ring 76 lie between the crucible flange 16 and the conducting block 64 which are held together by a bolt 78 which passes through the block 64 but which is electrically insulated therefrom by insulated washer 80. The O-ring 74 and an insulating ring 76 both hydraulically seal and electrically insulate the upper crucible flange 16 and its associated outer crucible jacket 72 from the bus bar 66.

As is more fully described in copending application Ser. No. 616,365 now U.S. Pat. No. 4,032,705, cooling water is fed to and from the cooling system of the crucible 12 by two inlet conduits (not shown) preferably spaced 180° apart and two outlet conduits (not shown) also spaced 180° apart. Cooling water flows from the inlet conduits down the space between the outer surface of intermediate water guide 56 and the inner surface of crucible jacket 72 and then up through the space between the inner surface of the water guide 56 and the outer surface of the crucible body 52.

The cooling water applied to the inlet conduits need not exceed standard industrial water pressures of 40 to 80 psi. Very little pressure drop is experienced in the coolant flow in the space between the outer jacket and the water guide. However, the flow restriction created by the narrow annulus formed between the water guide 56 and the crucible body 52 accelerates the water flow to an ultrahigh velocity of 15 feet per second or greater. This ultrahigh velocity flow sweeps away steam which has formed on the outer wall of the crucible body and greatly increases the overall heat transfer rate.

In addition to creating an ultrahigh water velocity flow on the outer surface of the crucible body, the intermediate water guide 56 is utilized as a return conductor running from the bottom of the crucible body 52 to the bus bar 66. It will be appreciated that the concentric closely spaced guide 56 thereby provides an absolutely perfect coaxial return current conduction through the crucible assembly 12 thus keeping the effects of magnetic stirring of the molten metal within the crucible to a minimum.

The remaining return conducting path from the bus bar 66 to the enclosure 24 and thus to the conductor 82 (See FIG. 1) is through the atmosphere control sleeve 30. As shown in FIGS. 3 and 4, the lower portion of atmosphere control sleeve 30 includes an inwardly directed annular flange 84. The inner vertical surface of the flange 84 has an annular groove 86 therein within which is prearranged an O-ring 88. With sleeve 30 in its uppermost position as shown in FIG. 4, O-ring 88 seals against the machined outer vertical surface of the upper crucible flange 16. The seal between the crucible flange 16 and the lower end of the sleeve 30 is between two adjacent vertical walls thereby allowing for any differential vertical thermal expansion by the various furnace components.

With the sleeve 30 in its uppermost position, the electrical connection to the bus bar 66 is made by bolting the electrically conductive block 90 to the upper surface of flange 84 by the use of bolt 92. These parts are accessible for assembly from the outside of the sleeve 30 through port 35. After assembly, port 35 is obviously closed so as to maintain the integrity of the atmosphere within the crucible 12, space 28 and the head 18.

It should be readily apparent that while only one bus bar arrangement is shown in FIGS. 3 and 4, two or more such arrangements may be and are preferably employed. These are preferably equally spaced about the periphery of the furnace 10. In addition, it should be noted that the bus bar 66 is preferably of a multi-layer laminated configuration which allows for some flexure vertical movement caused by any differential thermal expansion between the various furnace components.

In an alternate embodiment, the atmosphere control sleeve may be mounted within or without the furance head and be lowered to mate with the crucible top flange. Alternatively, the sleeve may be built in two or more sections: the first of these sections being lowered on to the top of the crucible assembly after the electrode has been installed in the crucible and the other, which would then need only be a few feet tall, may be telescoped down from within or without the furnace head enclosure.

The present invention may be embodied in other specific forms without departing from the spirit or essential attributes thereof and, accordingly, reference should be made to the appended claims, rather than to the foregoing specification as indicating the scope of the invention.

I claim:

1. In an electroslag melting furnace comprising a crucible means and a furnace head spaced from the top of said crucible means, said furnace head being adapted to suspend a consumable electrode within said crucible means, the improvement comprising: means for making the space between said crucible means and said furnace head air tight, said means including a sleeve member and means for moving said sleeve member between an inoperative position and an operative position wherein said sleeve member substantially surrounds said space and means allowing for the control of the atmosphere within said space; said sleeve member having a first end adapted to be electrically connected to said crucible means and a second end adapted to be electrically connected to said furnace head whereby said sleeve member, when in said operative position, is adapted to function as part of the return conductor path between said crucible means and the power supply for said furnace.

2. The improvement as claimed in claim 1 further including means adjacent the top of said crucible means for creating a substantially air tight seal between the crucible means and the bottom of said sleeve member and means adjacent the bottom of said furnace head for creating a substantially air tight seal with the top of said sleeve member.

3. The improvement as claimed in claim 1 wherein said sleeve member is adapted to move in a telescoping relationship with either one of said furnace head or said crucible means.

4. The improvement as claimed in claim 1 wherein said crucible means includes a concentrically arranged crucible jacket, crucible body and intermediate conductive water guide and including means for electrically interconnecting the bottom of said sleeve member to said water guide.

5. In an electroslag melting furnace comprising a crucible means and a furnace head spaced from the top of said crucible means, said furnace head being adapted to suspend a consumable electrode within said crucible means, the improvement comprising: means for making the space between said crucible means and said furnace head air tight, said means including an enclosure means for enclosing the space between said furnace head and said crucible means and means for moving said enclosure means relative to both said furnace head and said crucible means, said means for moving being adapted to move said enclosure means between an inoperative position and an operative position wherein said enclosure means encloses said space, and means allowing for the control of the atmosphere within said space; said enclosure means having a first end adapted to be electrically connected to said crucible means and a second end adapted to be electrically connected to said furnace head whereby said enclosure means, when in said operative position, is adapted to function as part of the return conductor path between said crucible means and the power supply for said furnace.

6. The improvement as claimed in claim 5 further including means adjacent the top of said crucible means for creating a substantially air tight seal between the crucible means and the bottom of said enclosure means and means adjacent the bottom of said furnace head for creating a substantially air tight seal with the top of said enclosure means.

7. The improvement as claimed in claim 5 wherein said crucible means includes a concentrically arranged crucible jacket, crucible body and intermediate conductive water guide and including means for electrically interconnecting the bottom of said enclosure means to said water guide.

8. In a consumable electrode furnace comprising a crucible means and a furnace head spaced from the top of said crucible means, said furnace head being adapted to suspend a consumable electrode within said crucible means, the improvement comprising: a telescoping sleeve member adapted to be moved in a telescoping relationship with said furnace head or said crucible means between an inoperative position and an operative position wherein said sleeve member substantially encloses the space between said crucible means and said furnace head, said sleeve member having a first end adapted to be electrically connected to said crucible means and a second end adapted to be electrically connected to said furnace head whereby said sleeve member, when in said operative position, is adapted to function as part of the return conductor path between said crucible means and the power supply for said furnace.

9. The improvement as claimed in claim 8 wherein said sleeve member, when in said operative position, is adapted to make said space air tight and further including means allowing for the control of the atmosphere within said space.

10. The improvement as claimed in claim 8 further including means adjacent the top of said crucible means for creating a substantially air tight seal between the crucible means and the bottom of said sleeve member and means adjacent the bottom of said furnace head for creating a substantially air tight seal with the top of said sleeve member.

11. The improvement as claimed in claim 8 wherein said crucible means includes a concentrically arranged crucible jacket, crucible body and intermediate conductive water guide and including means for electrically interconnecting the bottom of said sleeve member to said water guide.

* * * * *